US007424997B2

(12) United States Patent
Achtari et al.

(10) Patent No.: US 7,424,997 B2
(45) Date of Patent: Sep. 16, 2008

(54) DEVICE FOR COMPENSATING THE WEIGHT OF A SUSPENDED LOAD

(75) Inventors: Mohammad S. Achtari, Bad Krozingen (DE); Thomas Steinle, Hartheim (DE)

(73) Assignee: Carl Stahl Kromer GmbH, Freiburg (DE)

( * ) Notice: Subject to any disclaimer, the term of this patent is extended or adjusted under 35 U.S.C. 154(b) by 0 days.

(21) Appl. No.: 11/950,733

(22) Filed: Dec. 5, 2007

(65) Prior Publication Data

US 2008/0135819 A1 Jun. 12, 2008

(30) Foreign Application Priority Data

Dec. 8, 2006 (DE) ..... 10 2006 057 901

(51) Int. Cl.
*B66D 1/14* (2006.01)

(52) U.S. Cl. ..... 254/278; 242/375.1

(58) Field of Classification Search ..... 242/375.1, 242/375.3, 375; 254/278, 277, 383
See application file for complete search history.

(56) References Cited

U.S. PATENT DOCUMENTS

| | | | | |
|---|---|---|---|---|
| 1,685,585 | A * | 9/1928 | Grimes | 242/375.1 |
| 2,939,680 | A * | 6/1960 | Powell | 254/340 |
| 3,615,065 | A * | 10/1971 | Elliott | 242/375.1 |
| 4,003,552 | A * | 1/1977 | Sobolewski | 254/283 |
| 4,664,334 | A * | 5/1987 | Asagiri et al. | 242/372 |
| 5,988,596 | A * | 11/1999 | Mitchell et al. | 254/271 |
| 6,042,087 | A * | 3/2000 | Heinemann | 254/364 |
| 6,065,705 | A * | 5/2000 | Schmitt | 242/375.1 |
| 6,467,713 | B1 * | 10/2002 | Watanabe et al. | 242/375.1 |

FOREIGN PATENT DOCUMENTS

| | | |
|---|---|---|
| DE | 1938245 | 5/1970 |
| DE | 3323716 | 5/1984 |
| DE | 3512112 | 10/1986 |
| GB | 1273436 | 5/1972 |

* cited by examiner

*Primary Examiner*—Emmanuel M Marcelo
(74) *Attorney, Agent, or Firm*—Volpe & Koenig, PC

(57) ABSTRACT

A device (1) that compensates the weight of a suspended load, for example a tool or welding tongs, is provided as a spring tensioner with at least one barrel (4) or supporting wire that can be reeled off a barrel (3) against the force of a spring (2). The barrel (3) is supported on a shaft (6), to which the spring (2) engages directly with its interior end or via a sheath connected to the shaft (6), while the opposite exterior end of the spring (2) is mounted to the barrel (3) at the inside. A shaft drive (7) can be activated to change the pull force at the spring (2) via the shaft (6). The spring (2) is connected to the shaft drive (7) or to a drive wheel (8) allocated thereto via a freewheel. The freewheel is embodied with a catching latch arrangement (9) which, in the blocking direction has at least three or four latches (10) that simultaneously engage the recesses or catching recesses (11) which receive them, said latches being arranged at the inside at a circular drive wheel (12) allocated to a drive wheel (8). An interior body (13) of the catching latch arrangement located inside the circular drive wheel (12) supports the latches (10) and is simultaneously a part of a slide bearing for the circular drive wheel (12) for rotation in the freewheel direction. In this way, in a small space strong forces can be transferred.

13 Claims, 3 Drawing Sheets

DEVICE FOR COMPENSATING THE WEIGHT OF A SUSPENDED LOAD

BACKGROUND

The invention relates to a device for compensating a suspended load, in particular a tool or welding tongs to be operated manually, in the form of a counterweight or a spring tensioner with at least one spring, in particular a coil spring or a coiled leaf spring, operating against the force, a suspension wire that can be reeled off a barrel, with the barrel being supported rotationally on a shaft, directly engaged by the spring with its internal end or via a sheath connected to the shaft, while the external end of the spring engages the barrel, with the shaft drive acting on the spring to change the support via the shaft, and the spring being connected to the shaft drive and a drive wheel arranged on the shaft and allocated to the shaft drive via a freewheel, which responds in the sense of a free wheel with its internal end when the spring is relaxed prior to disconnection or disengagement.

Such a device for compensating the weight of a suspended load in the form of spring tensioner is known from DE 35 12 112 A1; however, it has not been implemented in practice. This primarily is because the free wheel described in this preliminary publication is disclosed for one rotational direction as a friction clutch and for the other rotational direction as a clamping brake, which represents an expensive arrangement. Furthermore, the transfer of the necessary torque is limited when using, on the one hand, a friction clutch and, on the other hand, a clamping brake, in particular due to the only very limited space available inside the drive wheel of a spring tensioner, and furthermore the production of a clamping brake is expensive. Particularly, the clamping brake disclosed in the preliminary publication as a preferred means to prevent the disconnection or disengagement of the interior spring end from the shaft is not well suited to transferring strong torques.

SUMMARY

Therefore, the object is to provide a device or a spring tensioner of the type defined at the outset with the freewheel arranged inside the drive wheel having a space requirement that is as small as possible, but is able to transfer a strong torque in spite of this.

In order to attain this seemingly contradicting object the counterweight or spring tensioner according to the invention is provided with a catching latch arrangement for a freewheel, in which in the blocking direction at least three latches simultaneously engage recesses accepting them in the blocking direction, the recesses are arranged at the inside of a circular drive wheel allocated to the drive wheel, and an interior body of the catching latch arrangement arranged inside the circular drive wheel, pivotally supporting the latches, is simultaneously a part of a slide bearing for the circular drive wheel, rotational in reference to the interior wheel in the freewheel direction.

In this way, a clamping brake is replaced by a catching latch arrangement transferring considerably stronger torque. The seemingly higher expense of three or preferably four or more latches in reference to a common catching latch arrangement having one or two latches allows a transfer of a relatively strong torque in the blocking direction, with the forces developing here being distributed over several latches, so that based on the small space requirement, relatively small latches are still able to match these forces. Simultaneously, a roller bearing frequently provided in such freewheels is avoided, which also would have required a lot of space. Rather, the interior body of the catching latch arrangement fulfills a dual function, in which, on the one hand, the latches can be pivoted radially outwards and, on the other hand, are supported at the circular drive ring of the drive wheel.

In a beneficial manner here the circular drive wheel is held for rotation, without the use of roller bearings, at the outside of the interior body in reference thereto in the alignment direction of the latches and held blocked from rotation against the alignment direction of the latches. Thus, the interior of the circular drive wheel may contain the catching latch arrangement, which simultaneously supports the circular drive wheel in the free rotational direction, even when for reasons of space it may be sized not larger than or only slightly larger than a drive wheel without a freewheel and/or without a catch.

Here, it is particularly beneficial when the interior body of the catching latch arrangement comprises bearing material or non-iron metal, in particular brass. Due to the fact that according to the invention simultaneously at least three latches engage in case of the transfer of a torque and when under load, thus a load occurring is well distributed, the solidity of brass is sufficient to withstand such braking loads. Simultaneously the advantage results that brass is a very good bearing material and can easier processed than steel, for example.

One embodiment of the invention may provide that four, five, or six simultaneously effective engaging latches are provided, each of which in the catching position engages in allocated catching recesses of the circular drive wheel, and that the shape and the size of all catching recesses are identical, as are the latches. Thus, the torque that can be even better transferred on a small space and/or the loads better distributed to compensating individual latches, and further a higher security results in case that perhaps one of the latches in the operational position is not or insufficiently engaging and effective. Several additional latches can still compensate a respectively strong torque. Here, the effect can be even increased when seven or eight latches are provided.

It is beneficial when more catching recesses than latches are provided. Accordingly small steps in the rotational direction lead always to another insertion of the latches into the respective catching recesses, i.e. very small rotational angles of the circular drive wheel can each be blocked.

For example, two, three, or four times as many catching recesses can be provided at the interior side of the circular drive wheel than latches effective for the catching latch arrangement. In a catching latch arrangement having three latches, for example, nine or twelve or perhaps even fifteen catching recesses can be provided at the circular drive wheel. The circular drive wheel then has an appropriate number of catching positions.

For an even torque transfer it is advantageous when the latches of the catching latch arrangement are provided evenly over the circumference of the interior body, supported pivotally, and are of an even distance in reference to each other in the circumferential direction as well as having identical shapes and sizes. By an even distribution of the latches over the circumference of the interior body the forces to be compensated by them in case of loads are distributed accordingly evenly and introduced into the catches.

A particularly beneficial embodiment of the invention may provide that each bearing end of the latches opposite to the effective latch tips that engage in a catching recess has a circularly shaped exterior contour and engages a recess of the interior body effective as a slide bearing as a support site, fitting as a negative for the respective latch, with its curvature radius being approximately equivalent to the arched external contour of the latch at its bearing end and supporting the latch in its end positions and during pivoting. The latches are therefore not held by a bearing pin subjected in the loaded case to a bending or shearing force but can at their end themselves introduce the respective forces into a bowl shaped supporting-recess of the interior body.

Another embodiment of the invention with a considerably beneficial importance may comprise that the back of the latch extending between the two ends of the respective latches and arranged radially at the outside is convexly bent or curved in the operational position and under load is supported in a controlled fashion in the catching recess of the circular drive wheel by an approximately axially parallel linear contact, with the support site being spaced from the tip of the latch forming the free end of the latch.

In this manner, a good force transfer can be achieved via the latches between the bearing body and the circular drive wheel, with the risk being reduced or avoided that the latch tips located at the free ends break under high loads. Under load, the flow of force is guided from the tip of the latches to the bent back of the latches and here conducted into an appropriate section of the catching recess of the circular drive wheel. This largely contributes to the ability for very strong torques to be transferred via the catching latch arrangement in a very narrow space, because the loads need not be compensated by the tips of the latches alone.

Another beneficial embodiment of the arrangement according to the invention may comprise that the interior body is provided with a shoulder, encircling the circumference and arranged at one of the faces of the interior body, as an axial stop for the circular drive wheel and/or a recess arranged in the facial surface of the circular drive wheel and that as a counter stop of the circular drive wheel, in the axial direction, a nut is provided at a distance from the shoulder, which impinges the other facial region of the circular drive wheel in the operational condition or overlaps it. This allows a detachable assembly of the circular drive wheel, which in the operational position is held in a form-fitting manner between the shoulder and the nut, each in the axial direction, and which in the circumferential direction is rotational in the direction of the alignment of the latches and in the opposite direction can be fixed by the latches.

Here, the shoulder can be embodied in one piece with the interior body and may comprise the same material so that it completes the slide bearing for the circular interior wheel.

The nut, serving to axially fix the circular drive wheel at the interior body, may also comprise the same bearing material, non-iron metal, or preferably brass, as the interior body, and also be a component of the slide bearing of the circular drive wheel.

For a space-saving arrangement it is additionally beneficial when the circular drive wheel is annealed or hardened and is particularly provided with gearing at the outside or is embodied as a worm gear. Based on this annealing or hardening, this circular drive wheel can be sized appropriately small and still transfer strong torque, such as the ones occurring in a worm gear drive and which may be necessary for adjusting the spring tensioner.

Primarily combinations of individual or several of the above-described features and measures result in a spring tensioner for compensating the weight of a suspended load, in which a strong torque can be transferred on a very small space at a drive wheel and its circular drive wheel, without risking that a latch of the catching latch arrangement provided is insufficient for the load developing here. Simultaneously a relatively cheap production results in that a roller bearing in the area of the drive wheel is avoided and a catching latch arrangement is used which in spite of the use of at least three latches, can be produced cheaper than a clamping brake and can transfer the already mentioned stronger torque.

BRIEF DESCRIPTION OF THE DRAWINGS

In the following an exemplary embodiment of the invention is described in greater detail using the drawing. It shows in a partially schematic representation.

DETAILED DESCRIPTION OF THE PREFERRED EMBODIMENTS

Figure 1:
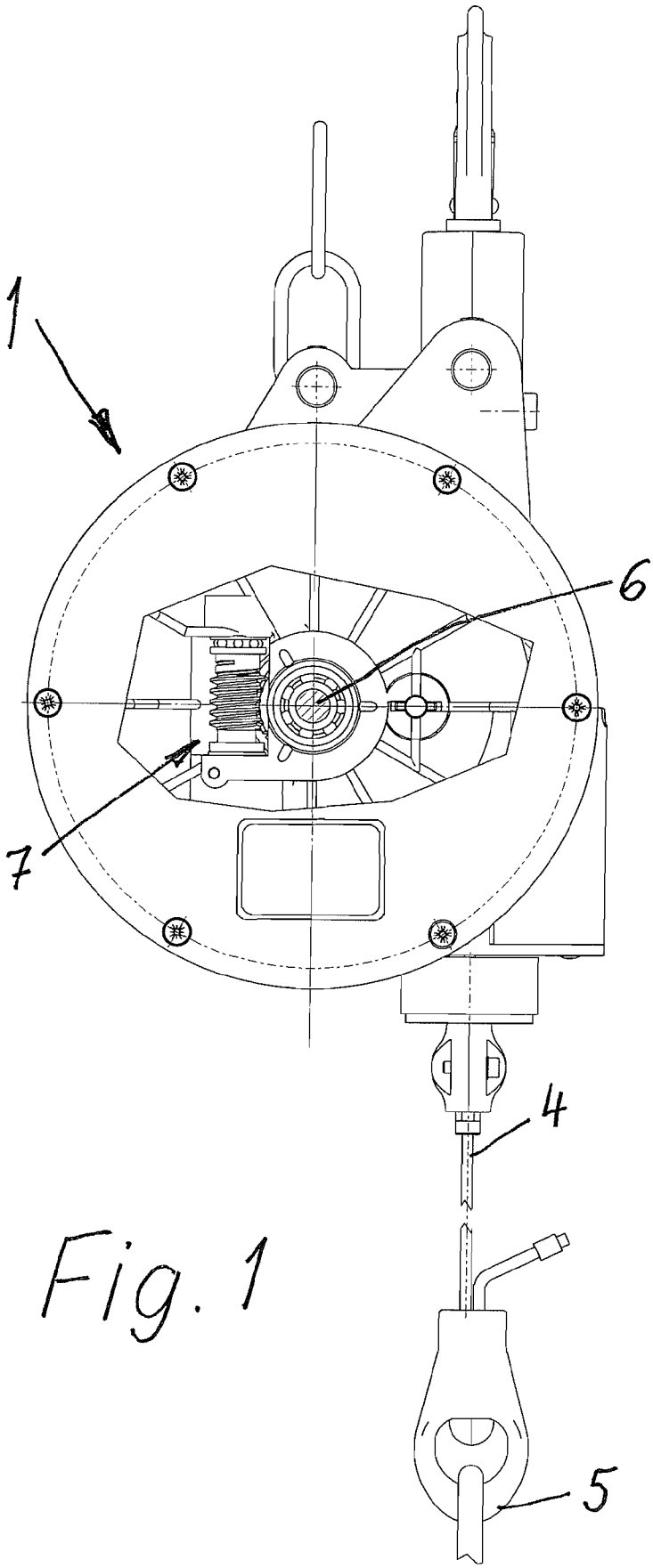
FIG. 1 is a side view of a spring tensioner according to the invention, cut in the area of the worm gear, in an enlarged scale.

The device, in its entirety marked 1, serves to compensate the weight of a suspended load not shown in greater detail, for example a tool or welding tongs to be manually operated and is embodied as a spring tensioner referred to as "spring tensioner 1" in the following.

This device 1 and/or its spring tensioner 1 is provided with a tackle 4 against the force of a spring 2, in the exemplary embodiment a helical coiled leaf spring that can be reeled off a conical barrel 3, essentially embodied as a supporting wire for the suspended load and provided therefore with an engagement device 5.

The barrel 3 is supported rotational on a shaft 6 normally horizontal in the operational state, to which the spring 2 is directly engaged with its interior end or via a sheath connected to the shaft 6, as overall known from DE 3 512 112 A1, which is incorporated herein by reference as if fully set forth.

The exterior end of the spring 2 engages in a manner also known per se at the inside of the barrel 3, with a shaft drive, in its entirety called 7, provided in the exemplary embodiment as an essential part of the worm gear drive, acts at the spring 2 to change the support force via the shaft 6 and the spring 2 being connected to the shaft drive 7 and a drive wheel 8 arranged on the shaft 6 allocated to the shaft drive 7 via a freewheel, enacting free wheeling when the spring 2 is relaxed prior to the dissolution or disengagement of its interior end. When the spring is relaxed excessively due to the shaft drive 7 being activated too long it cannot be detached from the shaft 6 though because the above-mentioned freewheel, to be described in the following, is activated.

Figure 3:
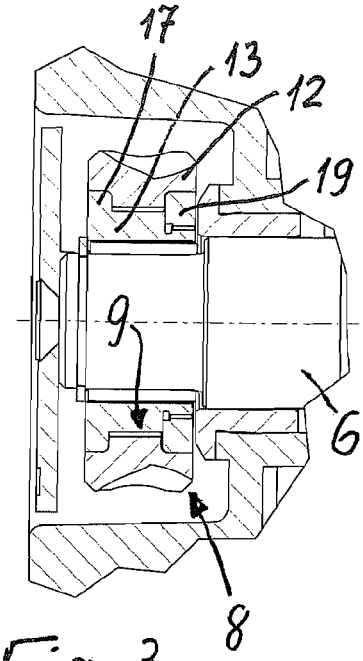
FIG. 3 is an enlarged scale view of the detail marked with the circle K in FIG. 2, from which particularly the fixation of the circular drive wheel to an interior body is discernible allocated to a catching latch arrangement.
Figure 2:
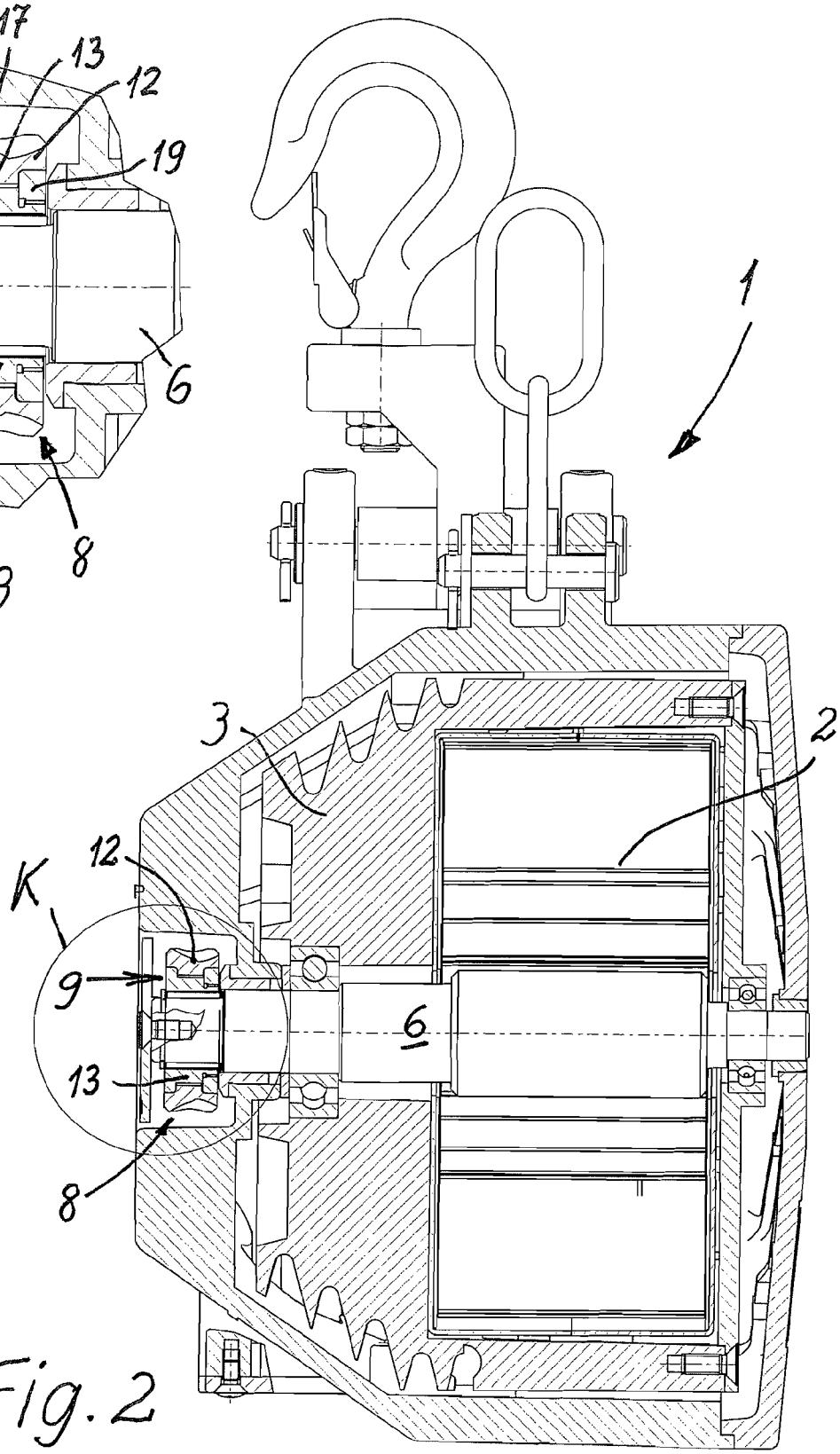
FIG. 2 is a longitudinal cross-sectional view through a spring tensioner and its drive wheel embodied as a worm gear, which is provided with a catching latch arrangement inside a circular drive wheel.
Figure 4:
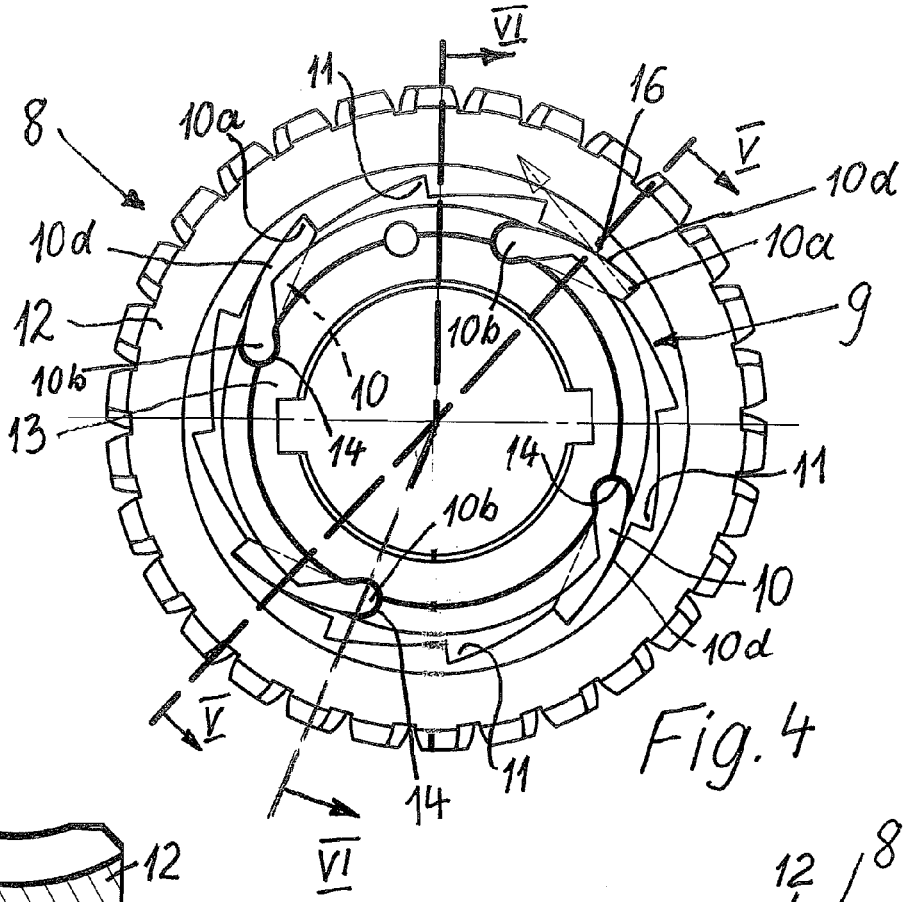
FIG. 4 is a side view of a drive wheel with its circular drive wheel, provided at the inside with recesses for the latches of the catching latch arrangement, with four latches pivotally supported at the interior body simultaneously engaging such recesses.
Figure 6:
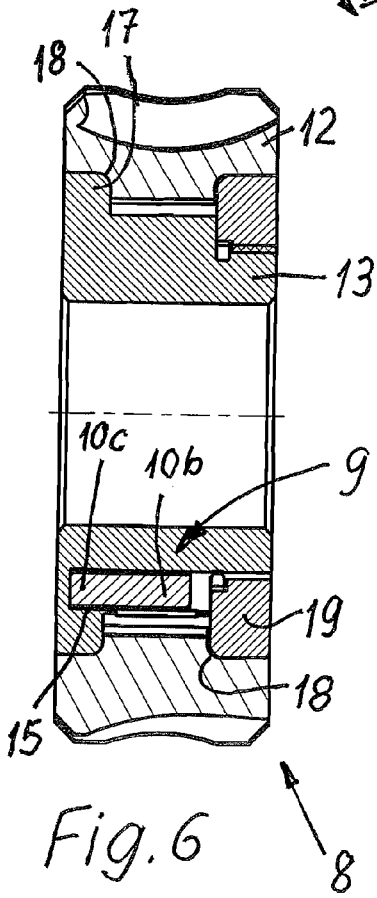
FIG. 6 is a longitudinal cross-sectional view through the drive wheel with the catching latch arrangement according to the cutting line VI-VI in FIG. 4.
Figure 5:
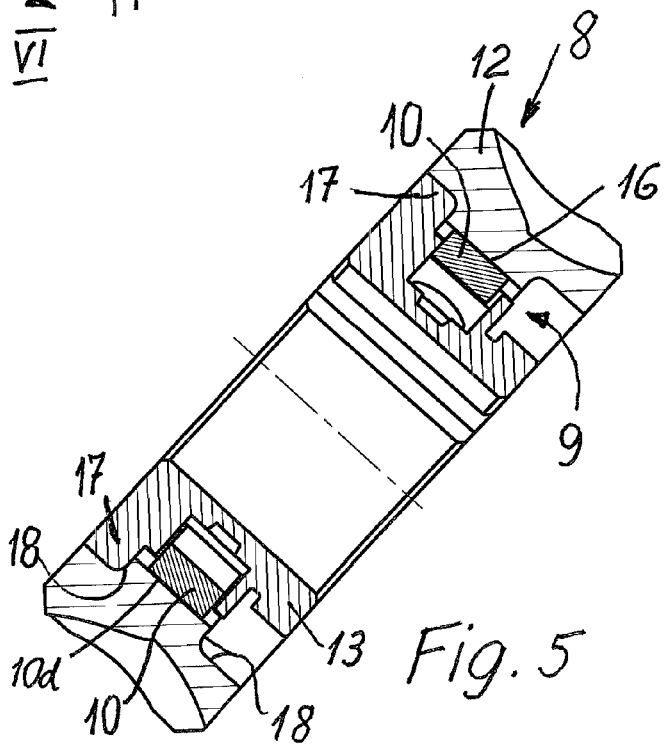
FIG. 5 is a longitudinal cross-sectional view through the drive wheel with the catching latch arrangement according to the section line V-V in FIG. 4.

In the exemplary embodiment, a catching latch arrangement 9 is provided as a freewheel inside the drive wheel, shown in greater detail in FIGS. 4 through 6, in which in the blocking direction in the exemplary embodiment four latches 10 are simultaneously engaged in the recesses 11 accepting them in the blocking direction, as is particularly discernible in FIG. 4. The recesses 11 are here arranged at the interior of a circular drive wheel 12 allocated to the drive wheel 8, and an interior body 13 of the catching latch arrangement 9 is arranged inside the circular drive wheel 12 and pivotally supports the latches 10, accepting the rotational circular drive wheel 12 at its exterior as a slide bearing for the rotation in the freewheel direction, as is easily discernible in FIGS. 2 and 3 and FIGS. 5 and 6.

The circular drive wheel 12 therefore contains at the inside a freewheel embodied as a catching latch arrangement 9, so that it requires no additional space. Here, the drive wheel 8 essentially comprises the interior body 13 and the circular drive wheel 12, with latches 10 being arranged between these two parts so that in one rotational direction the entire drive wheel 8 is rotated while in the opposite rotational direction with a counter force on the shaft 6, the circular drive 12 can be rotated in reference to the interior body 13 on the latches 10 supported here and not engaged accordingly.

From FIGS. 3 through 6 it is discernible that the circular drive wheel 12 is held, without using a roller-bearing, at the exterior of the interior body 13 and rotatable in reference thereto in the orienting direction of the latches 10 and held blocked against rotation in the alignment of the latches 10. Thus, no space is required for a roller bearing between the circular drive wheel 12 and the interior body 13. Here, this arrangement is possible because the interior body 13 is formed or embodied as a part of the slide bearing for the circular drive wheel 12. Here, the interior body 13 comprises a beneficial bearing material or non-iron metal, in particular brass, so that it can fulfill its purpose particularly well, being a part of the slide bearing for the circular drive wheel 12.

In FIG. 4 it is discernible that the catching recesses, i.e. recesses 11, in the following also called "catching recesses 11", are identical in shape and size and that more catching recesses 11 are provided than latches 10, so that even relatively slight rotations of the circular drive wheel 12 can again lead to a new blocking position, i.e. allow a very fine-tuned adjustment of the force of the spring 2. The four simultaneously engaging latches 10 are here evenly distributed over the circumference of the interior body 13, supported in a pivotal manner, and in the circumferential direction they have an even distance from each other as well as identical shapes and sizes, so that each of them engage simultaneously the appropriately sized and distanced catching recesses when the circular drive wheel 12 is rotated in reference to the interior body 13. Here, in the exemplary embodiment, three times as many recesses or catching recesses 11 are provided, however, it may also be only twice as many or four times as many catching recesses 11 in reference to the latches 10 at the interior side of the circular drive wheel 12.

Using FIGS. 4 and 6 it is discernible that each effective latch tip 10*a* engaging a catching recess 11 when blocking, and has an opposite bearing end 10*b* of the latches 10 with an arc-shaped exterior contour and is embodied as a bearing site for the respective latch 10 with a negative recess 14 effective as a slide bearing in the interior body 13, with its bending radius being appropriately equivalent to the arc-shaped exterior contour of the latch 10 at its bearing end 10*b* and supports the latch 10 in its end position and during its deflection. The pressures acting thereupon in the latch alignment direction when blocking are therefore introduced two-dimensionally into the interior body 13 to the recess 14 serving as the support, so that even under great forces the area compression can be limited.

Here, it is discernible in FIG. 6, in which the bearing end 10*b* of a latch is visible in a longitudinal cross-section, that at this bearing end 10*b* another lateral pin-shaped protrusion 10*c* is provided, which engages a perforation 15, axially continuing from the bearing recess 14, so that the latches 10 can be supported in a well centered manner at the interior body 13.

The back of the latch 10*b* extending between the two ends 10*a* and 10*d* of the respective latch 10, in the operational state arranged at the outside, is bent convexly or curved and supported under load according to FIG. 4 in a controlled manner in the catching recess 11 of the circular drive wheel 12 with an appropriately axially parallel linear contact, with this supporting site 16 is at a distance from the latch tip 10*a* forming the free end of the latch and also from the bearing end 10*b*. This results in the condition that under load not only the latch tip 10*a* and the bearing end 10*b* accept the forces, but additionally the latch 10 is supported at its back 10*a*, which reduces or excludes any risk of breaking even for a strong torque.

In order for the interior body 13 to fulfill its slide bearing function for the circular drive wheel 12, according to FIG. 3, 5, and 6, it has at one of its faces and/or axial limits a shoulder 17 encircling at the circumference as an axial stop for the circular drive wheel 12, with this circular drive wheel 12 being provided with a recess 18 at its face, which accepts and/or covers the shoulder 17, as particularly well discernible in FIGS. 5 and 6.

A nut 19 is provided as a counter support for the circular drive wheel 12, axially spaced apart from the shoulder 17, which covers the other facial areas of the circular drive wheel 12 in the operational state, with this nut 19 also being recessed at a recess 18 in the operational position, so that the overall width of the circular drive wheel 12 and the interior body 13 are approximately equivalent to the shoulder 17 and the thread for the fixing nut 19.

Here, in the exemplary embodiment the interior body 13 is formed in one piece with the shoulder 17, i.e. the interior body 13 and the shoulder 17 comprise one piece and thus also the same material so that the shoulder 17 is allocated to act as the slide bearing for the circular drive wheel 12.

The nut 19 serving to axially fix the circular drive wheel 12 at the interior body 13 and the shoulder 17 can here comprise the same bearing material, non-iron metal, or brass, similar to the interior body 13 and its shoulder 17, and thus also complement the slide bearing for the circular drive wheel 12. This can be annealed or hardened so that its exterior gearing can compensate equivalently high stress when embodied as a worm gear, even when the dimensions are relatively small, which is advantageous based on the small space available in the spring tensioner 1.

The device 1 serves to compensate the weight of a suspended load, for example a tool or welding tongs, and is provided as a spring tensioner with at least one tackle 4 or a supporting wire that can be reeled off a barrel 3 against the force of a spring 2. The barrel 3 is here supported on a shaft 6, which the spring 2 directly engages with its interior end or via a sheath connected to the shaft 6, while the opposite exterior end of the spring 2 at the barrel 3 is mounted at the inside. The shaft drive 7 can be activated at the spring 2 to change the suspension force via the shaft 6. The spring 2 is connected to the shaft drive 7 or a drive wheel 8 allocated thereto via a freewheel. The freewheel is embodied as a catching latch arrangement 9, which in the blocking direction has at least three or four latches 10 that simultaneously engage accepting recesses or blocking recesses 11 in the blocking direction, and which are arranged at the inside of a circular drive wheel 12 allocated to the drive wheel 8. An interior body 13 arranged inside the circular drive wheel 12 supports the latches 10 of the catching latch arrangement and is simultaneously a part of a slide bearing for the circular drive wheel 12 which is rotational in the free-wheeling direction. Thus strong forces can be transferred in a small space.

The invention claimed is:

1. A device (1) for compensating the weight of a suspended load comprising a counterweight or spring tensioner including at least one spring (2) opposing a force, a rope pull (4) or supporting wire to be reeled off a barrel (3), with the barrel (3) being supported for rotation on a shaft (6), which the spring (2) directly engages with its internal end or via a sheath connected to the shaft (6), while an external end of the spring (2) engages the barrel (3), and a shaft drive (7) for changing a supporting force acts via the shaft (6) to the spring (2) and the spring (2) with the shaft drive (7) and a drive wheel (8) arranged on the shaft (6) allocated to the shaft drive being connected via a freewheel, which when the spring (2) is relaxed prior to its loosening or disengagement of the internal end is activated in a manner of a freewheel, the freewheel includes catching latch arrangement (9) which, in a blocking direction has at least three latches (10) that simultaneously engage recesses (11) which receive the latches in the blocking direction, the recesses (11) are arranged at an inside of a circular drive wheel (12) allocated to the drive wheel (8) and an internal body (13) of the catching latch arrangement (9) is arranged inside the circular drive wheel (12), pivotally supporting the latches (10), simultaneously being a part of a slide bearing for the circular drive wheel (12) that is rotational in a freewheel direction.

2. A device according to claim 1, wherein the circular drive wheel (12) is held without roller bearings at an exterior of the interior body (13) in reference thereto for rotation in a direction of alignment of the latches (10) and is blocked against rotation against an alignment direction of the latches (10).

3. A device according to claims 1, wherein the interior body (13) of the catching latch arrangement comprises a bearing material, a non-iron metal or brass.

4. A device according to claim 1, wherein four, five, or six simultaneously effectively engaging latches (10) are provided, which engage in the blocking direction each in a corresponding one of the catching recesses (11) of the circular drive wheel and a shape and size of all of the catching recesses (11) are identical.

5. A device according to claim 4, wherein there are more of the catching recesses (11) than the latches (10).

6. A device according to claim 5, wherein twice, three times, or four times as many of the catching recesses (11) are provided at an interior side of the circular drive wheel (12) than a number of the catching latches (10).

7. A device according to claim 1, wherein the latches (10) of the catching latch arrangement (9) are distributed evenly over a circumference of the interior body (13) and supported pivotally and in a circumferential direction have an identical distance from each other and uniform shapes and sizes.

8. A device according to claim 1, wherein each of the effective latch tips (10*a*) that engages in a respective one of the catching recesses (11) has an opposite bearing end (13*b*) of the latches (10) with an arc-shaped external contour, and engages in a recess (14) of the interior body (13) acting as a slide bearing and as a negative bearing point for the respective latch (10), with an external bending radius being approximately equivalent to an arc-shaped exterior contour of the latch (10) at the bearing end (10*b*) and supporting the latch (10) in an end position and during pivoting.

9. A device according to claim 8, wherein latch backs (10*d*) of the latches arranged in an operational state at an outside, and extending between the two ends (10*a*, 10*b*) of the respective latches (10) are convexly bent or curved and under load supported in a controlled manner in the catching recess (11) of the circular drive wheel (12) with an approximately axially parallel linear contact, with the supporting site (16) being at spaced apart from the free end of the latch tip (10*a*) forming the latch.

10. A device according to claim 1, wherein the interior body (13) is provided with a shoulder (17), encircling a circumference thereof and arranged at a face, which acts as an axial stop for the circular drive wheel (12) having a recess (18) arranged at a face of the circular drive wheel and as a counter support of the circular drive wheel (12), spaced apart in reference to the shoulder (17), a nut (19) is provided, which covers the other face of the circular drive wheel (12) in an operational state.

11. A device according to claim 1, wherein the shoulder (17) is made in one piece with the interior body (13) and comprises the same material.

12. A device according to claim 11, wherein the nut (19) serving to axially fix the circular drive wheel (12) at the interior body (13) comprises the same bearing material, non-iron metal, or brass, as the interior body (13).

13. A device according to claim 1, wherein the circular drive wheel (12) is annealed or hardened and has external gearing or comprises a worm gear.

* * * * *